US008759696B2

(12) United States Patent
Nishikimi et al.

(10) Patent No.: US 8,759,696 B2
(45) Date of Patent: Jun. 24, 2014

(54) TRIGGER SWITCH FOR POWER TOOL

(75) Inventors: Junichi Nishikimi, Aichi (JP); Tatsuya Yoshizaki, Aichi (JP); Hiroyuki Hirose, Kanagawa (JP); Satoru Kowaki, Kanagawa (JP)

(73) Assignees: Makita Corporation, Aichi (JP); Satori S-Tech Co., Ltd., Tokyo (JP)

( * ) Notice: Subject to any disclaimer, the term of this patent is extended or adjusted under 35 U.S.C. 154(b) by 233 days.

(21) Appl. No.: 13/405,408

(22) Filed: Feb. 27, 2012

(65) Prior Publication Data

US 2012/0234657 A1 Sep. 20, 2012

(30) Foreign Application Priority Data

Mar. 15, 2011 (JP) ..... 2011-056412

(51) Int. Cl.
*H01H 13/06* (2006.01)

(52) U.S. Cl.
USPC ..... 200/302.2

(58) Field of Classification Search
USPC ..... 200/302.1, 302.2, 302.3, 333, 332.2, 200/505, 520, 323, 325, 341
See application file for complete search history.

(56) References Cited

FOREIGN PATENT DOCUMENTS

| | | |
|---|---|---|
| JP | 2001-118449 | 4/2001 |
| JP | 2003-109451 | 4/2003 |
| JP | 2006-277998 | 10/2006 |
| JP | 2009-012153 | 1/2009 |
| JP | 2011-065767 | 3/2011 |
| JP | 2011-146197 | 7/2011 |

*Primary Examiner* — Edwin A. Leon
*Assistant Examiner* — Anthony R. Jimenez
(74) *Attorney, Agent, or Firm* — Wenderoth, Lind & Ponack, L.L.P.

(57) ABSTRACT

A trigger switch includes a case having a switching mechanism inside thereof and open on one side, a cover configured to be fitted inside an opening of the case to close the opening, and a trigger arranged outside of the case and configured to operate the switching mechanism by sliding operation via the plunger. An engaging depression is formed on an inner wall surface defining an opening edge portion of the case. A shoulder is formed on an outer peripheral end edge portion of the cover. An engaging projection is formed to project outward from a side surface of the shoulder to a small extent so as to be capable of engaging with the engaging depression corresponding thereto. A joint groove is formed by the inner wall surface of the opening edge portion of the case and the shoulder, and the joint groove is filled with an adhesive agent.

16 Claims, 10 Drawing Sheets

TRIGGER SWITCH FOR POWER TOOL

BACKGROUND OF THE INVENTION

1. Field of the Invention

The present invention relates to a trigger switch for a power tool and, more specifically, to a trigger switch for a power tool having improved dustproof properties and waterproof properties so as to endure use in a dusty environment.

2. Prior Art

A trigger switch for a power tool in the prior art includes a trigger 14 on the outside thereof to be operated, a contact mechanism provided in the interior of a case 11 and configured to turn ON and OFF according to the movement of a plunger 22 sliding on the basis of the operation of the trigger 14 and, in addition, a motor connecting terminal 31, a signal terminal 35, and power connecting terminals 33 and 34 to be connected to a motor, a controller, a power source and the like on the outside arranged in a so-called exposed state via a terminal fitting portion 19 as shown in FIGS. 11 to 14. The terminals are configured to secure motor connecting lead wires 41 and 42, power connecting lead wires 43 and 44, and a signaling connection lead wire 45 with solder or screws.

Also, as shown in FIG. 13, the plunger 22 coupled to the trigger 14 is connected to the contact point mechanism in the interior thereof by the intermediary of an internal seal cover 24 provided in the interior of the case 11, and is configured to maintain a state in which the trigger 14 is constantly urged outward by the intermediary of a restoration spring 23 on the outside of the case 11.

Then, a cover 13 is attached to the case 11 provided with the contact point mechanism, and a joint portion between the attached case 11 and cover 13 is bonded by ultrasonic welding, so that improved dustproof properties and waterproof properties are achieved.

Furthermore, as shown in FIG. 14, the plunger 22 coupled to the trigger 14 is configured to be provided with an accordion-type external seal cover 15 on the outside on which the plunger 22 slides, and a restoration spring provided on this portion is stored in the interior of the case 11 not shown. In this manner, with the provision of the external seal cover 15 so as to close an engaging hole of the case 11 for the sliding movement of the plunger 22, entry of dust into the interior of the case 11 generated in association with the sliding movement of the plunger 22 may be prevented.

JP-A-2001-118449 and JP-A-2003-109451 are examples in the prior art.

However, in the switch for a power tool described in the prior art, the improvement of dustproof properties and waterproof properties are achieved by bonding by welding the joint portion between the case and the cover by the ultrasonic welding method when attaching the cover to the case, which is a so-called fitting member formed of a resin component. However, there is a problem that the switch cannot be disassembled after the bonding, and operations such as repair in the process cannot be performed.

There is also a problem that a portion where the cover is in contact with the case is in a rugged and complex shape, and accordingly the bonding effect is not sufficient.

In addition, since a terminal fitting portion cannot be welded by ultrasonic welding at portions of terminals, the bonding is still necessary. Therefore, a method of bonding the terminal fitting portions and terminal root portions with an adhesive agent may be employed. However, there arises a problem that there are many points to be bonded and the bonding operation is troublesome, so that the quality is affected by variations in bonding.

In addition, in a method of using the accordion-type external seal cover for preventing entry of dust or moisture from the plunger coupled to the trigger, in a trigger sliding portion, the external seal cover comes into contact with the plunger and slides in friction against the plunger. Therefore, the engaging hole where the plunger engages cannot be closed completely, and hence the probability of entry of dust or moisture into the interior of the switch still remains.

Therefore, it is necessary to simplify a fitting state of components including a case and a cover, which correspond to a fitting portion of the components and enhance dustproof properties and waterproof properties with minimum points of contact. Also, in a terminal fitting portion, it is necessary to enhance the dustproof properties and the waterproof properties by sealing with an adhesive agent or attaching a separate member such as a rubber seal cover. In addition, in a trigger sliding portion, it is necessary to enhance the dustproof properties and the waterproof properties at the time of operation of a trigger specifically by an external seal cover.

SUMMARY OF THE INVENTION

In order to solve the above-described problem, a trigger switch for a power tool according to the present invention is configured to include a case provided with a switching mechanism inside thereof and having an opening on one side; a cover configured to be fitted inside the opening of the case to close the opening; a trigger arranged outside of the case and configured to operate the switching mechanism by a sliding operation through a plunger; wherein an engaging depression is formed on an inner wall surface which defines an opening edge portion of the case, a shoulder is formed on an outer peripheral end edge portion of the cover, an engaging projection is formed to project outward from a side surface of the shoulder to a small extent so as to be capable of engaging with the engaging depression corresponding thereto, a joint groove is formed by the inner wall surface of the opening edge portion of the case and the shoulder, and the joint groove is filled with an adhesive agent.

Preferably, the trigger switch for a power tool further includes a restoration spring attached to an outer periphery of the plunger; and an accordion-type external seal cover configured to cover the restoration spring, wherein the trigger includes a cylindrical plunger engaging portion projecting inward at the center to allow fitting of a distal end portion of the plunger. The plunger engaging portion is formed on the outer peripheral side thereof with a spring engaging portion which allows engagement of a distal end portion of the spring, and with a seal cover-engaging portion having a larger thickness via a wall surface where a distal end of the restoration spring abuts, and the distal end portion of the accordion-type external seal cover is engaged with an outer periphery of the seal cover-engaging portion, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

Further, the trigger switch for a power tool preferably further includes a restoration spring attached to an outer periphery of the plunger, and an accordion-type external seal cover configured to cover the restoration spring, wherein the trigger includes a cylindrical plunger engaging portion projecting inward at the center to allow fitting of a distal end portion of the plunger, the outer peripheral side of the plunger engaging portion is formed with a spring engaging portion which allows engagement of a distal end portion of the spring, and the distal end portion of the external seal cover is clamped between the spring engaging portion and the restoration spring, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

The plunger is formed with a pin engaging hole in the orthogonal direction at the distal end portion thereof, the plunger engaging portion corresponding to the pin engaging hole is formed with a pin fitting hole communicating with the pin engaging hole, and a retaining pin is inserted into the pin engaging hole and the pin fitting hole. The pin fitting hole is sealed by bonding an upper portion of the retaining pin with the adhesive agent, so that the dustproof properties and the waterproof properties can further be enhanced.

The plunger is formed with the pin engaging hole in the orthogonal direction at the distal end portion thereof, the plunger engaging portion corresponding to the pin engaging hole is formed with a pin fitting hole communicating with the pin engaging hole, and a retaining pin is inserted into the pin engaging hole and the pin fitting hole, and the upper portion of the retaining pin is sealed with a seal cover formed of a resilient member, so that the dustproof properties and the waterproof properties may be enhanced.

With the configuration that the case and the cover are formed to be elongated to a position where terminals arranged in a terminal fitting portion and projecting to the outside is covered, and opening portions on a lower side and an upper side including root portions of lead wires connected to the terminals is bonded with the adhesive agent, entry of moisture from the portions of the terminals exposed to the outside can also be reliably prevented.

With the configuration that the case and the cover are formed to be elongated to a position where terminals arranged in a terminal fitting portion and projecting to the outside is covered, and a seal cover configured to cover root portions of lead wires connected to the terminals is mounted, entry of moisture from the portions of the terminals exposed to the outside is prevented and higher waterproof properties are achieved.

The trigger switch for a power tool according to the invention includes an engaging depression formed on an inner wall surface which defines an opening edge portion of the case, a shoulder formed on an outer peripheral end edge portion of the cover, an engaging projection formed so as to project outward from the side surface of the shoulder to a small extent and to be engageable with the engaging depression corresponding thereto, and a joint groove formed by the inner wall surface of the opening edge portion of the case and the shoulder, and the joint grooves are filled with an adhesive agent. Therefore, when a cover surface is faced upward, all the joint grooves are faced upward, so that the adhesive agent can be filled easily, uniformly and stably, adequate adhesion is enabled, and the dustproof properties and the waterproof properties can further be enhanced.

With the structure in which the external seal cover is arranged so as to cover the plunger without coming into direct contact with the outer peripheral surface of the plunger and causes the end portion of the external seal cover to be tightly engaged, entry of dust or moisture through the external seal cover exposed to the outside can be prevented.

Furthermore, by sealing the pin fitting hole by adhering the upper portion of the retaining pin inserted into the pin fitting hole formed on the plunger engaging portion with the adhesive agent, entry of dust or moisture via the pin can be prevented.

Furthermore, with the configuration in which the point where the lead wires are connected to the terminals projecting to the outside is filled with the adhesive agent or covered with the seal cover, entry of dust or moisture via the terminals can be prevented.

DETAILED DESCRIPTION OF THE PREFERRED EMBODIMENTS

Figure 1:
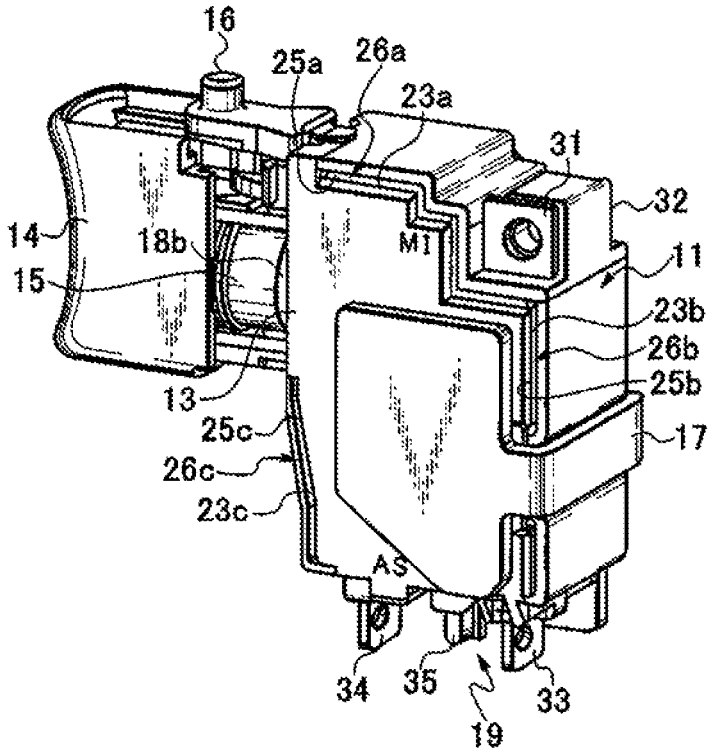
FIG. 1 is a front and upper right side perspective view of a trigger switch for a power tool according to a first embodiment of the invention.

Referring now to the drawings, embodiments of a trigger switch for a power tool according to the invention will be described. FIGS. 1 to 4 show a trigger switch for a power tool according to a first embodiment of the invention, which includes a case 11 having an opening on a front side and formed into a box shape elongated in the vertical direction, a cover 13 configured to cover the opening of the case, a switching mechanism provided in the case 11, and a trigger 14 configured to perform a switching operation of the switching mechanism by a sliding operation by the intermediary of a plunger 22.

The case 11 integrally includes a contact point unit 12 having a switching mechanism mounted thereon, and a terminal fitting portion 19 opening for exposing a terminal portion of the contact point unit 12 on the lower side. A plunger opening 18*a* is formed into a semi-cylindrical shape for causing the plunger 22 to slide therein on a side surface thereof to transmit an operating action from the trigger 14 arranged on the outside of the case. Further, motor connecting terminals 31 and 32 to be connected to a motor are exposed from an upper end of the case 11, and power terminals 33 and 34 is connected to the terminal fitting portion 19 to be connected to the outside, and signal terminals 35 and 36 to be connected to a controller are exposed from a lower end.

The cover 13 includes a plunger opening 18*b* formed into a semi-cylindrical shape to allow entry and exit of the plunger 22 which constitutes a sliding operating element 21 on a side surface thereof. The trigger 14 is installed on the outside and is coupled to the plunger 22 of the sliding operating element 21, and causes the plunger 22 to enter and exit through a cylindrical opening formed by the plunger openings 18*a* and 18*b* of the case 11 and the cover 13.

Figure 2A:
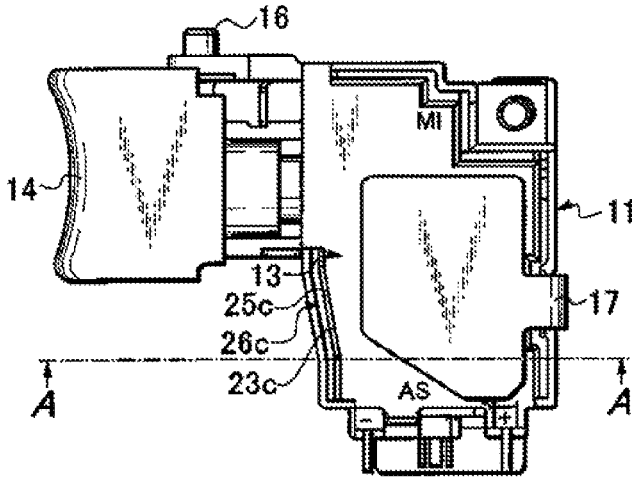
FIG. 2A is a front view of the trigger switch for a power tool.
Figure 2B:
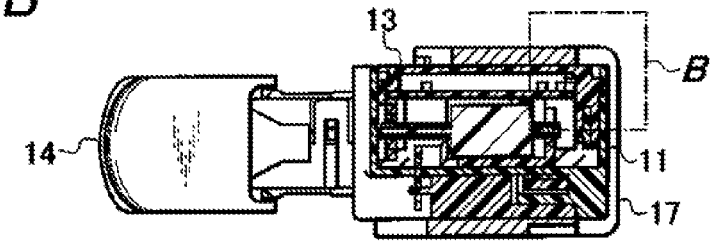
FIG. 2B is a cross-sectional view taken along the line A-A in FIG. 2A.
Figure 2C:
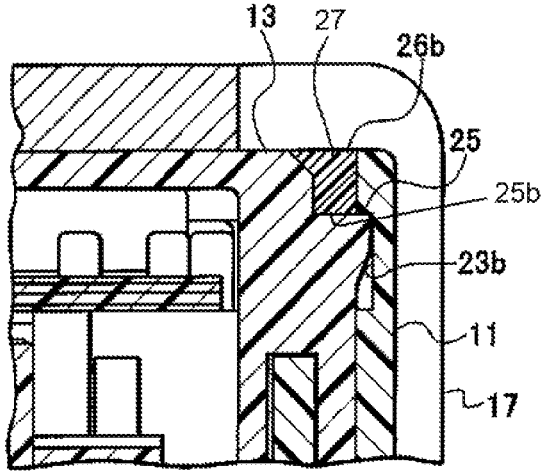
FIG. 2C is an enlarged view of a portion B in FIG. 2B.
Figure 3:
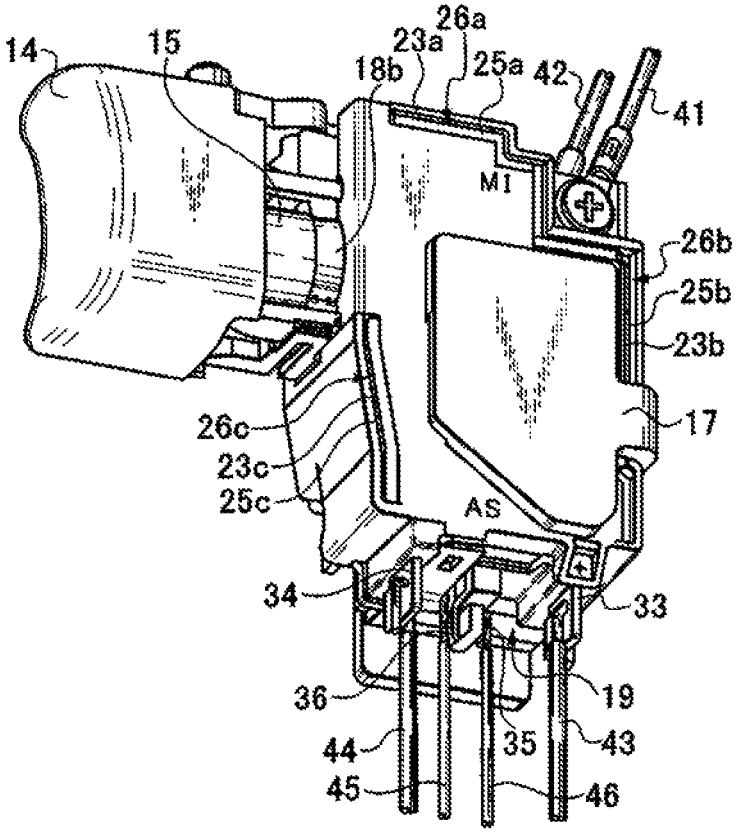
FIG. 3 is a front, left and lower side perspective view of a state in which cables are attached to the trigger switch for a power tool.
Figure 4:
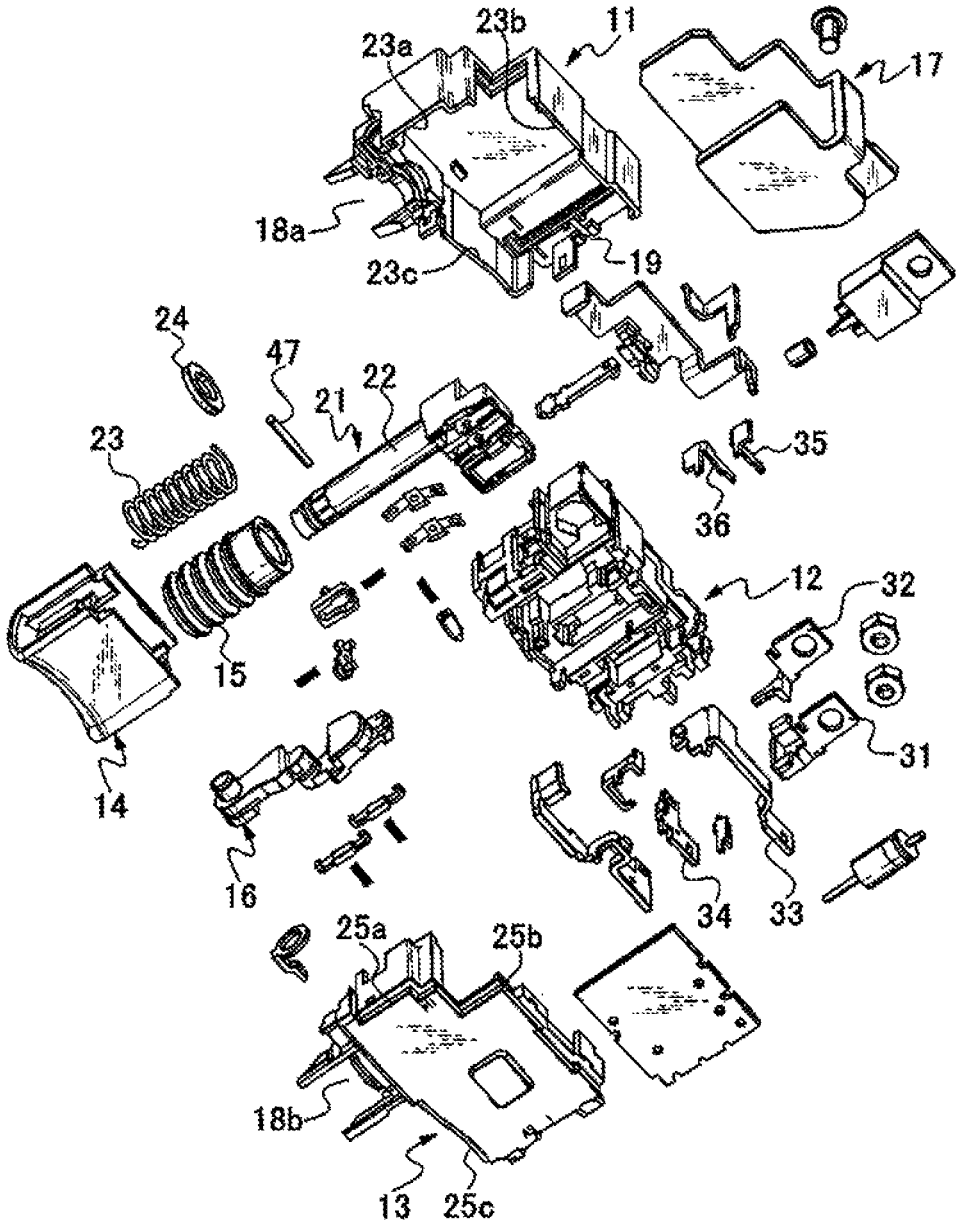
FIG. 4 is an exploded perspective view showing the trigger switch for a power tool.

The case 11 is formed with engaging depressions 23*a*, 23*b*, and 23*c* at an end edge portion on the side of an opening inside a sidewall other than the plunger opening 18*a* to allow entry and exit of the plunger 22 and the terminal fitting portion 19 in which the terminals are arranged. In contrast, shoulders 25*a*, 25*b*, and 25*c* are formed on an outer peripheral end edge portion of the cover 13 corresponding to the engaging depressions 23*a*, 23*b*, and 23*c*, and engaging projections 25 project outward from the side surface of the shoulders to a small extent, as shown in FIG. 2C. The engaging projections 25 each include an inclined portion protruding gradually from the lower side toward the upper side, and an upper end portion thereof is formed to have a right angle. The cover 13 is formed so as to be fitted inside the opening of the case 11, and the engaging projections 25 are pushed downward while pushing an opening edge portion of the case 11 outward with the inclined portion when being inserted inside, and is fitted into the engaging depressions 23*a*, 23*b*, and 23*c*. In this fitted state, upper end portions of the engaging projections 25 engage the walls of the respective engaging depressions, and the cover 13 is prevented from coming apart.

In the above-described fitting state of the cover 13 with respect to the case 11, joint grooves 26*a*, 26*b*, and 26*c* are formed by an inner wall surface of the end edge portion on the opening side of the case 11 and the shoulders 25*a*, 25*b*, and 25*c* (see FIG. 2C). As described above, an adhesive agent 27 is filled in the joint grooves 26*a*, 26*b*, and 26*c* in a state in which the opening of the case 11 is closed by the cover 13. At this time, since all of the joint grooves 26*a*, 26*b*, and 26*c* are formed on the front side, the adhesive agent 27 can be filled with the front side faced upward. This configuration allows not only the quick and easy filling operation of the adhesive agent 27, but also solidification and stabilization of the filled adhesive agent as-is without flowing out from adhesive grooves. In this manner, the cover 13 and the case 11 are hermetically joined.

Also, arranged at a top of the contact point unit 12 is a switching operation unit 16 configured to switch the rotation of the motor. In addition, a heat sink plate 17 formed into a substantially U-shape is attached so as to clamp the outer periphery of the cover 13 and the case 11 hermetically joined.

Figure 5:
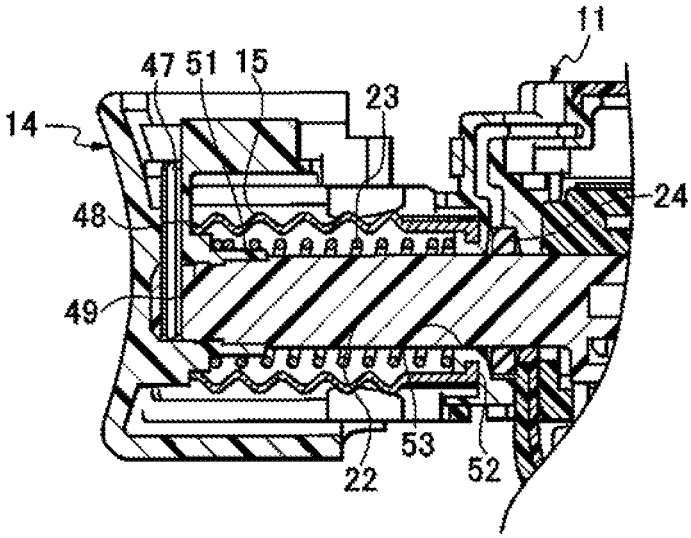
FIG. 5 is a partial cross-sectional view showing a mode of attachment of a seal cover to a plunger of the trigger switch.

As shown in FIG. 5, the plunger 22 coupled to the trigger 14 is coupled to the contact point mechanism in the interior thereof by the intermediary of an internal seal cover 24 provided in the interior of the case 11, and is configured to maintain a state in which the trigger 14 is constantly urged outward by the intermediary of a restoration spring 23 on the outside of the case 11. An accordion-type external seal cover 15 configured to cover the plunger 22 and the restoration spring 23 is also provided.

The coupling between the trigger 14 and the plunger 22 is achieved by fitting the distal end portion of the plunger formed with a pin fitting hole 54 into a cylindrical plunger engaging portion 49 formed at a substantially center in the interior of the trigger, and being prevented from coming apart by passing a pin 47 through a pin hole formed on a side wall of the plunger engaging portion 49 corresponding to the pin fitting hole 54. The plunger engaging portion 49 includes a spring engaging portion 51 which allows engagement of a distal end portion of the restoration spring 23 on the outer peripheral side thereof, and is formed with a seal cover-engaging portion 48 having a larger thickness via a wall surface where a distal end of the restoration spring 23 abuts, and a distal end portion of the accordion-type external seal cover 15 is engaged with an outer periphery of the seal cover-engaging portion 48. In contrast, a proximal end portion of the external seal cover 15 is engaged with an engaging groove 52 formed on an outer peripheral side of a plunger insertion hole 53 formed on the plunger opening of the case 11. Accordingly, a structure in which the external seal cover 15 does not come into direct contact with an outer peripheral surface of the plunger 22, and covers the entire part of an outer periphery of the restoration spring 23 is achieved. The seal cover-engaging portion 48 may be provided with a depression for an engagement with the distal end portion of the external seal cover 15 to achieve a structure which further resists dislodging during the operation.

Figure 6:
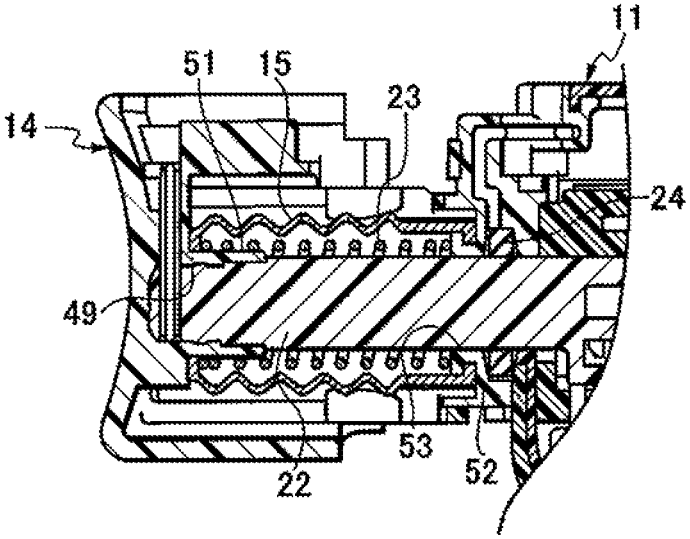
FIG. 6 is a partial cross-sectional view showing a mode of attachment of another seal cover to the plunger of the trigger switch.

FIG. 6 shows another mode of mounting of the external seal cover 15, in which the distal end portion of the external seal cover 15 is secured by being clamped between a wall surface of the spring engaging portion 51 of the plunger engaging portion 49 and the restoration spring 23. In this manner, by clamping the distal end portion of the external seal cover 15 between the wall surface of the spring engaging portion 51 and the distal end of the restoration spring 23, the external seal cover 15 can hardly be dislodged during the operation and hence the waterproof properties are further improved.

Figure 7:
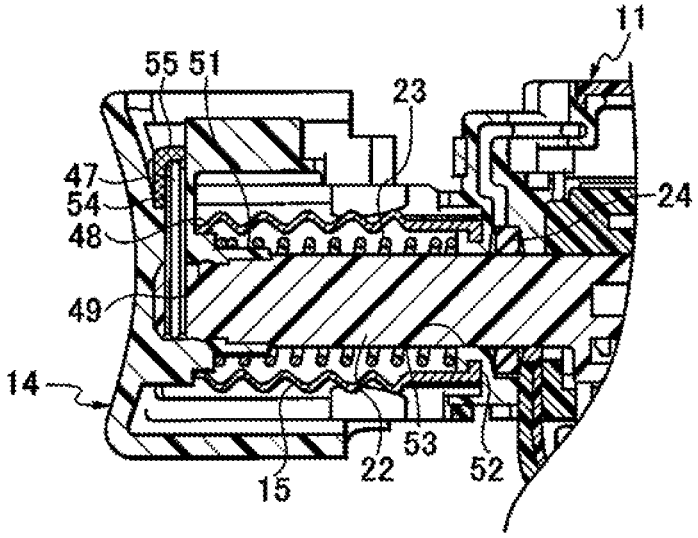
FIG. 7 is a partial cross-sectional view showing a state in which a pin fitting portion for attaching the plunger to a trigger of the trigger switch is bonded and sealed with a resin.

FIG. 7 shows a mode in which the external seal cover 15 is attached in the mode shown in FIG. 5, and, in addition, the pin fitting hole 54 is sealed by covering and bonding the upper portion of the retaining pin 47 of the plunger 22 inserted through the pin fitting hole 54 with resin 55. In this configuration, dust and moisture may be prevented from entering along the pin 47.

Figure 8:
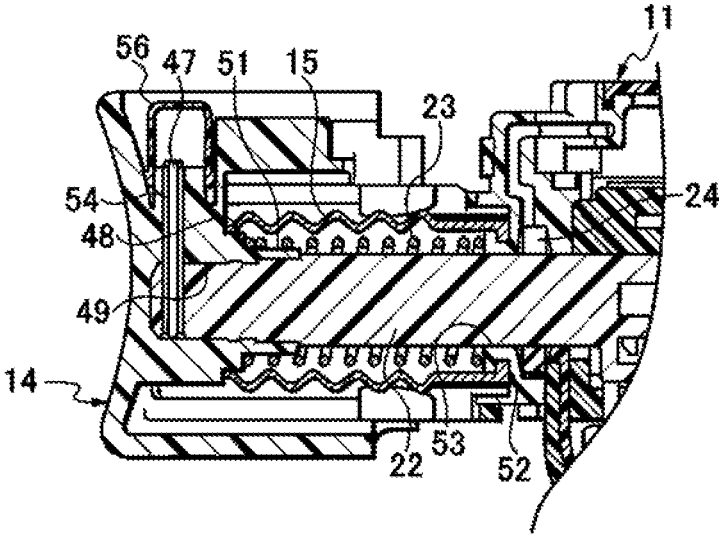
FIG. 8 is a partial cross-sectional view showing a state in which the pin fitting portion for attaching the plunger to the trigger of the trigger switch is sealed with the seal cover.

FIG. 8 shows a mode in which the external seal cover 15 is attached in the mode shown in FIG. 5, and the pin fitting hole 54 is sealed at the upper portion of the retaining pin 47 of the plunger 22 inserted through the pin fitting hole with a seal cover 56 as a resilient member. In this mode, dust and moisture may be prevented from entering along the pin 47.

Figure 9A:
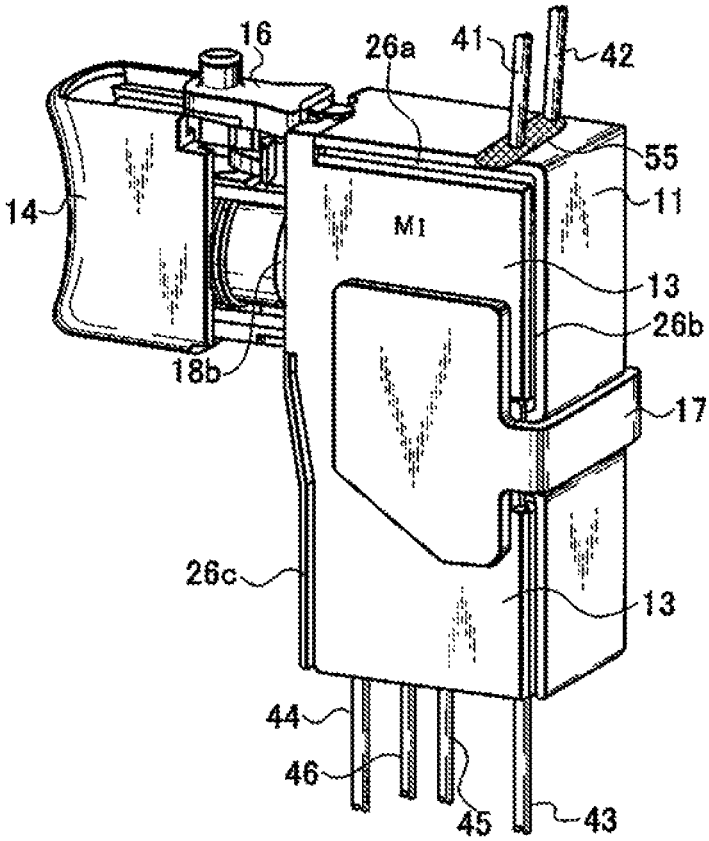
FIG. 9A is a front and upper right side perspective view of a trigger switch for a power tool according to a second embodiment of the invention.
Figure 9B:
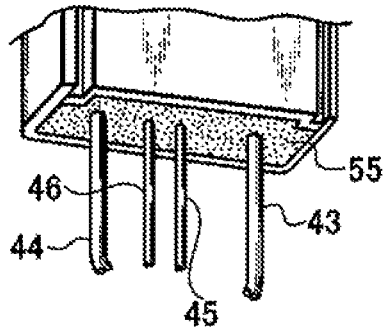
FIG. 9B is a front and lower left side partial perspective view of a bottom portion of the trigger switch.
Figure 10A:
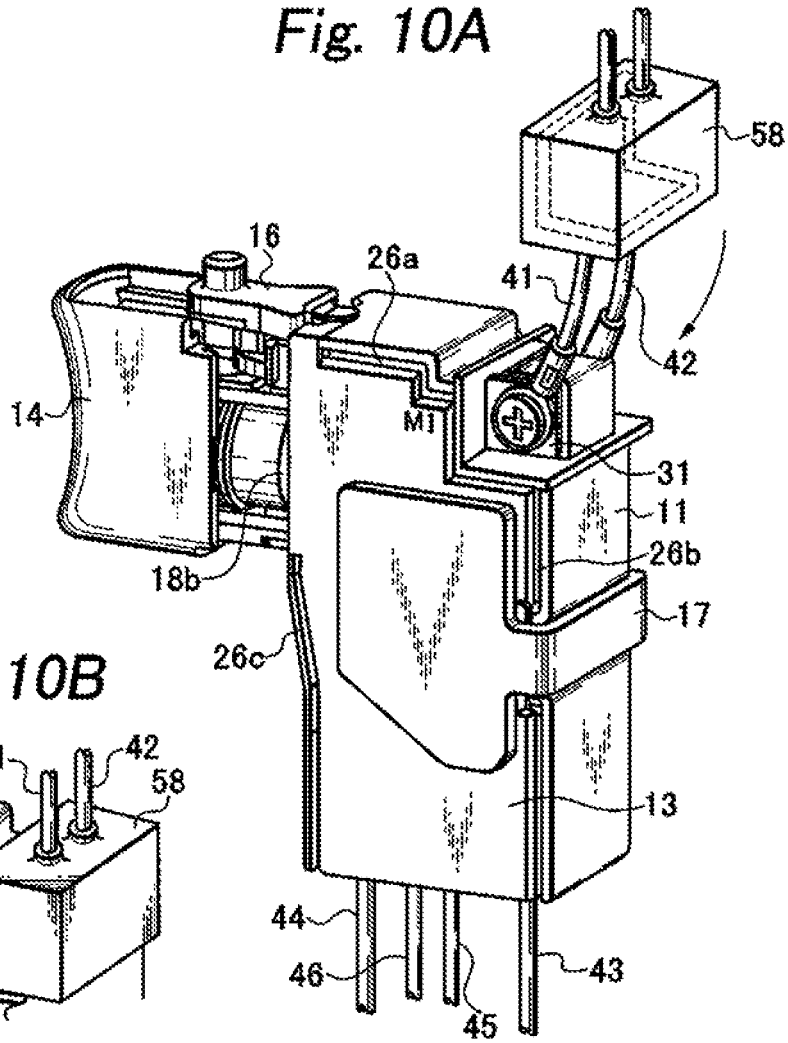
FIG. 10A is a front and upper right side perspective view of the trigger switch for a power tool according to a third embodiment of the invention.
Figure 10B:
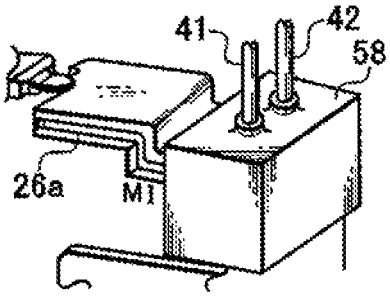
FIG. 10B is a partial perspective view showing a state in which motor connecting terminals of the trigger switch are covered with a seal cover.
Figure 10C:
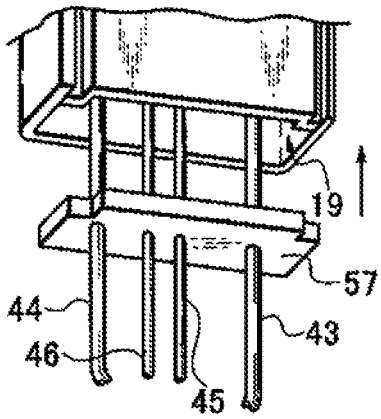
FIG. 10C is a partial perspective view showing a state of attachment of a seal cover which covers lead wires extending from a terminal fitting portion of the bottom portion of the trigger switch.
Figure 10D:
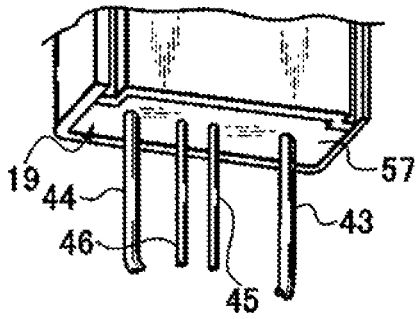
FIG. 10D is a partial perspective view showing a state in which the terminal fitting portion of the bottom portion of the trigger switch is covered with a seal cover.
Figure 11:
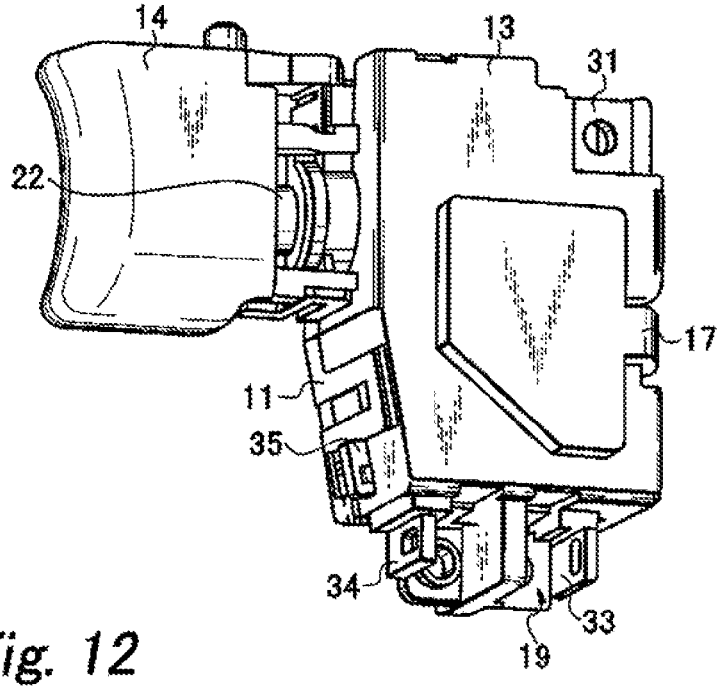
Fig. 11 PRIOR ART
FIG. 11 is a perspective view showing a trigger switch for a power tool in the prior art.
Figure 12:
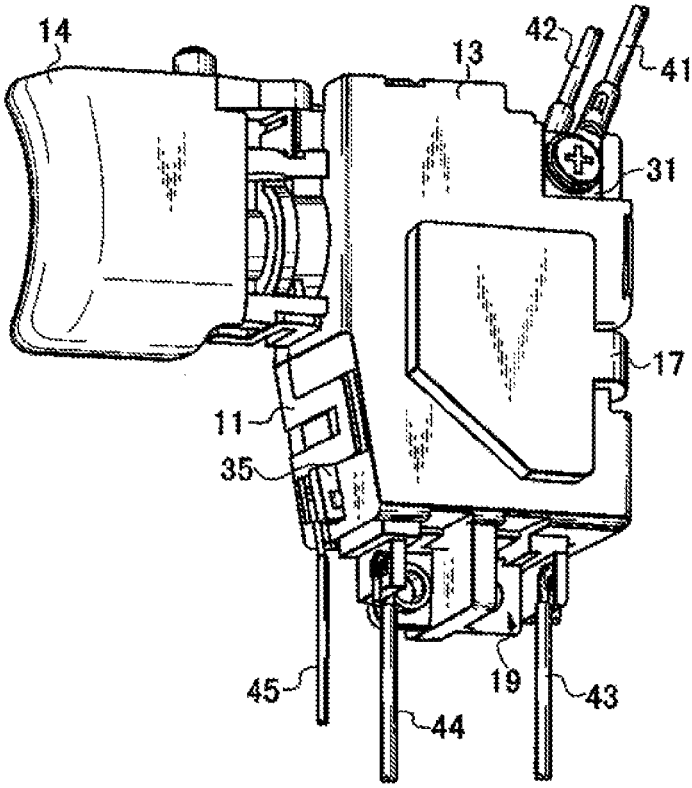
Fig. 12 PRIOR ART
FIG. 12 is a perspective view of a state in which cables are attached to the trigger switch for a power tool.
Figure 13:
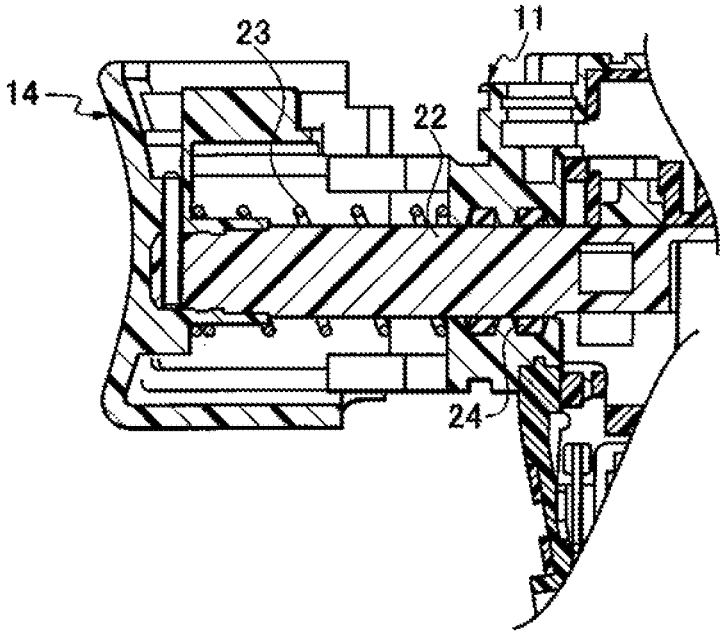
Fig. 13 PRIOR ART
FIG. 13 is a partial cross-sectional view showing a mode of attachment of a seal cover to a plunger of the trigger switch.
Figure 14:
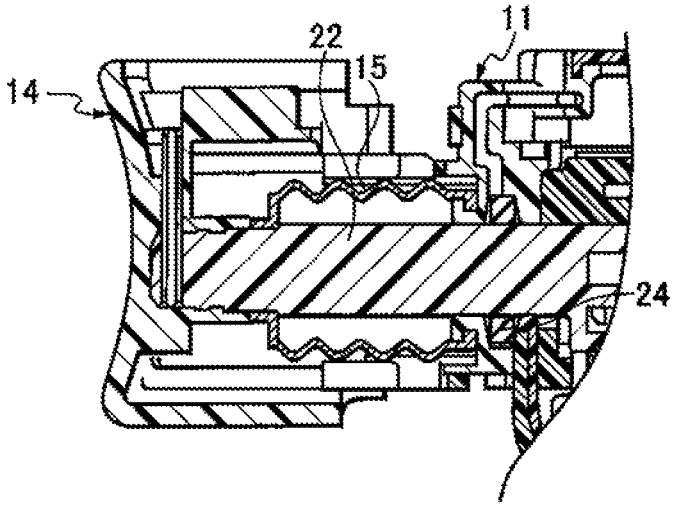
Fig. 14 PRIOR ART
FIG. 14 is a partial cross-sectional view showing a mode of attachment of another seal cover to the plunger of the trigger switch.

FIGS. 9A and 9B show the trigger switch for a power tool according to a second embodiment of the invention. The configuration in which the engaging projection 25 formed on the cover 13 is fitted into the engaging depressions 23*a*, 23*b*, and 23*c* of the case 11 and the joint grooves 26*a*, 26*b*, and 26*c* are formed by the inner wall surface of the end edge portion on the side of the opening of the case 11 and the shoulders 25*a*, 25*b*, and 25*c* to fill the joint grooves 26*a*, 26*b*, and 26*c* with the adhesive agent is the same as the first embodiment, and hence the description will be omitted.

In the second embodiment, the lower end sides of the case 11 and the cover 13 are elongated to a position where the power terminals 33 and 34 exposed from the terminal fitting portion 19 and the signal terminals 35 and 36 to be connected to the controller are covered, and root portions of the lead wires 43, 44 and 45, 46 attached to the respective terminals are filled and bonded with resin 55 as the adhesive agent. Also, root portions of the lead wires 41 and 42 attached to the motor connecting terminal portion of the upper end side are bonded with the resin 55 as the adhesive agent. In this configuration, entry of moisture or the like from the portions of the terminals exposed to the outside can be prevented.

FIGS. 10A to 10D show the trigger switch for a power tool according to a third embodiment of the invention. The configuration in which the engaging projection 25 formed on the cover 13 is fitted into the engaging depressions 23*a*, 23*b*, and 23*c* of the case 11 and the joint grooves 26*a*, 26*b*, and 26*c* are formed by the inner wall surface of the end edge portion on the side of the opening of the case 11 and the shoulders 25*a*, 25*b*, and 25*c* to fill the joint grooves 26*a*, 26*b*, and 26*c* with the adhesive agent is the same as the first embodiment, and hence the description will be omitted.

In the third embodiment, the lower end sides of the case 11 and the cover 13 are elongated to the position where the power terminals 33 and 34 exposed from the terminal fitting portion 19 and the signal terminals 35 and 36 to be connected to the controller are covered, and a seal cover 57 configured to close the opening of the root portions of the lead wires 43, 44 and 45, 46 attached to the respective terminals is provided. Also, the motor connecting terminal 31 exposed from the upper portion is also formed with a rib in advance, and a seal cover 58 formed with a groove on the inner side so as to fit the rib is attached to the rib. In this configuration, since entry of moisture from the portions of the terminals exposed to the outside can be prevented, higher waterproof properties can be obtained.

The trigger switch for a power tool according to the invention is superior in dustproof properties and waterproof properties and may be widely used as the trigger switch for a power tool which may be used in any operational environments.

What is claimed is:

1. A trigger switch for a power tool, comprising:

a case provided with a switching mechanism inside thereof and having an opening on one side;

a cover configured to be fitted inside the opening of the case to close the opening;

a trigger arranged outside of the case and configured to operate the switching mechanism by a sliding operation via a plunger;

wherein engaging depressions are formed on an inner wall surface which defines an edge portion of the opening of the case, shoulders are formed on an outer peripheral end edge portion of the cover, an engaging projection is formed to project outward from a side surface of each of the shoulders to a small extent so as to be capable of engaging with the engaging depression corresponding thereto, joint grooves are formed by the inner wall surface of the edge portion of the opening of the case and the shoulders, and the joint grooves are filled with an adhesive agent.

2. The trigger switch for a power tool, according to claim 1, further comprising:

a restoration spring attached to an outer periphery of the plunger; and an accordion-type external seal cover configured to cover the restoration spring, wherein the trigger includes:

a cylindrical plunger engaging portion projecting inward at the center to allow fitting of a distal end portion of the plunger, the plunger engaging portion is formed on the outer peripheral side thereof with a spring engaging portion which allows engagement of a distal end portion of the spring, and with a seal cover-engaging portion having a larger thickness via a wall surface where a distal end of the restoration spring abuts, and the distal end portion of the accordion-type external seal cover is engaged with an outer periphery of the seal cover-engaging portion, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

3. The trigger switch for a power tool, according to claim 1, further comprising:

a restoration spring attached to an outer periphery of the plunger, and an accordion-type external seal cover configured to cover the restoration spring, wherein the trigger includes:

a cylindrical plunger engaging portion projecting inward at the center to allow fitting of a distal end portion of the plunger, the outer peripheral side of the plunger engaging portion is formed with a spring engaging portion which allows engagement of a distal end portion of the spring, and the distal end portion of the external seal cover is clamped between the spring engaging portion and the restoration spring, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

4. The trigger switch for a power tool, according to claim 1, wherein the case and the cover are formed to be elongated to a position where terminals arranged in a terminal fitting portion and on the case and projecting to the outside are covered, and opening portions on a lower side and an upper side including root portions of lead wires connected to the terminals are bonded with the adhesive agent.

5. The trigger switch for a power tool, according to claim 1, wherein the case and the cover are formed to be elongated to a position where terminals arranged in a terminal fitting portion and projecting to the outside is covered, and seal covers configured to cover root portions of lead wires connected to the terminals and terminals arranged on the case as well as root portions of lead wires connected to the terminals are mounted respectively.

6. The trigger switch for a power tool, according to claim 1, wherein the opening of the case faces in a first direction, and the cover is fitted inside the opening from said first direction to close the opening; and each of the engaging projections projects outward from the shoulders in a direction different than said first direction.

7. The trigger switch for a power tool, according to claim 1, wherein the opening of the case faces in a first direction, and the cover is fitted inside the opening from said first direction to close the opening; and each of the engaging projections projects outward from the shoulders in a direction substantially perpendicular to said first direction.

8. The trigger switch for a power tool, according to claim 1, wherein the case has a plunger opening to allow entry and exit of the plunger;

the engaging depressions are formed on the inner wall surface to extend along a periphery of the opening of the case other than the plunger opening;

the shoulders are formed to extend along the outer peripheral end edge portion of the cover at locations corresponding to the engaging depressions formed to extend along the periphery of the opening of the case; and the joint grooves are formed between said shoulders and said inner wall surface of the case such that, when the opening of the case faces upwards, the joint grooves also face upwards and can be filled with the adhesive agent from above.

9. The trigger switch for a power tool, according to claim 8, wherein the cover has an opening at one side thereof that is closed by the case;

the shoulders are each formed at a right angle; and the engaging projections each include an inclined portion inclining gradually outwardly in a direction away from the opening of the cover.

10. The trigger switch for a power tool, according to claim 1, wherein the cover has an opening at one side thereof that is closed by the case;

the shoulders are each formed at a right angle; and the engaging projections each include an inclined portion inclining gradually outwardly in a direction away from the opening of the cover.

11. A trigger switch for a power tool, comprising:

a case provided with a switching mechanism inside thereof and having an opening on one side;

a cover configured to be fitted inside the opening of the case to close the opening;

a trigger arranged outside of the case and configured to operate the switching mechanism by a sliding operation via a plunger;

wherein the trigger comprises a cylindrical plunger engaging portion projecting inward at the center to allow fitting of a distal end portion of the plunger, engaging depressions are formed on an inner wall surface which defines an edge portion of the opening of the case, shoulders are formed on an outer peripheral end edge portion of the cover, an engaging projection is formed to project outward from a side surface of each of the shoulders to a small extent so as to be capable of engaging with the engaging depression corresponding thereto, joint grooves are formed by the inner wall surface of the edge portion of the opening of the case and the shoulders, the joint grooves are filled with adhesive agent, the plunger is formed with a pin engaging hole in an orthogonal direction at the distal end portion thereof, and the plunger engaging portion corresponding to the pin engaging hole is formed with a pin fitting hole communicating with the pin engaging hole, and a retaining pin is inserted into the pin engaging hole and the pin fitting hole, and the pin fitting hole is sealed by bonding an upper portion of the retaining pin with adhesive agent.

12. The trigger switch for a power tool, according to claim 11, further comprising:

a restoration spring attached to an outer periphery of the plunger; and an accordion-type external seal cover configured to cover the restoration spring, wherein:

the plunger engaging portion is formed on the outer peripheral side thereof with a spring engaging portion which allows engagement of a distal end portion of the spring, and with a seal cover-engaging portion having a larger thickness via a wall surface where a distal end of the restoration spring abuts, and the distal end portion of the accordion-type external seal cover is engaged with an outer periphery of the seal cover-engaging portion, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

13. The trigger switch for a power tool, according to claim 11, further comprising:

a restoration spring attached to an outer periphery of the plunger, and an accordion-type external seal cover configured to cover the restoration spring, wherein:

the outer peripheral side of the plunger engaging portion is formed with a spring engaging portion which allows engagement of a distal end portion of the spring, and the distal end portion of the external seal cover is clamped between the spring engaging portion and the restoration spring, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

14. A trigger switch for a power tool, comprising:

a case provided with a switching mechanism inside thereof and having an opening on one side;

a cover configured to be fitted inside the opening of the case to close the opening;

a trigger arranged outside of the case and configured to operate the switching mechanism by a sliding operation via a plunger;

wherein the trigger comprises a cylindrical plunger engaging portion projecting inward at the center to allow fitting of a distal end portion of the plunger, engaging depressions are formed on an inner wall surface which defines an edge portion of the opening of the case, shoulders are formed on an outer peripheral end edge portion of the cover, an engaging projection is formed to project outward from a side surface of each of the shoulders to a small extent so as to be capable of engaging with the engaging depression corresponding thereto, joint grooves are formed by the inner wall surface of the edge portion of the opening of the case and the shoulders, the joint grooves are filled with adhesive agent, the plunger is formed with a pin engaging hole in an orthogonal direction at the distal end portion thereof, and the plunger engaging portion corresponding to the pin engaging hole is formed with a pin fitting hole communicating with the pin engaging hole, and a retaining pin is inserted into the pin engaging hole and the pin fitting hole, and the upper portion of the retaining pin is sealed with a seal cover formed of a resilient member.

15. The trigger switch for a power tool, according to claim 14, further comprising:

a restoration spring attached to an outer periphery of the plunger; and an accordion-type external seal cover configured to cover the restoration spring, wherein:

the plunger engaging portion is formed on the outer peripheral side thereof with a spring engaging portion which allows engagement of a distal end portion of the spring, and with a seal cover-engaging portion having a larger thickness via a wall surface where a distal end of the restoration spring abuts, and the distal end portion of the accordion-type external seal cover is engaged with an outer periphery of the seal cover-engaging portion, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

16. The trigger switch for a power tool, according to claim 14, further comprising:

a restoration spring attached to an outer periphery of the plunger, and an accordion-type external seal cover configured to cover the restoration spring, wherein:

the outer peripheral side of the plunger engaging portion is formed with a spring engaging portion which allows engagement of a distal end portion of the spring, and the distal end portion of the external seal cover is clamped between the spring engaging portion and the restoration spring, and a proximal end portion of the external seal cover is engaged with an engaging groove formed on the outer peripheral side of a plunger insertion hole formed on a plunger opening of the case, so that the external seal cover does not come into direct contact with an outer peripheral surface of the plunger.

* * * * *